United States Patent [19]

Jacobs, Jr.

[11] 4,161,713

[45] Jul. 17, 1979

[54] FUSIBLE ELEMENT FOR ELECTRIC FUSES HAVING A RELATIVELY HIGH VOLTAGE RATING AND A RELATIVELY HIGH CYCLING PERFORMANCE

[75] Inventor: Philip C. Jacobs, Jr., Newtonville, Mass.

[73] Assignee: Gould, Inc., Rolling Meadows, Ill.

[21] Appl. No.: 886,034

[22] Filed: Mar. 13, 1978

[51] Int. Cl.[2] ..... H01H 85/12

[52] U.S. Cl. ..... 337/161; 337/159

[58] Field of Search ..... 337/290, 291, 292, 293, 337/294, 295, 158, 159, 160, 161, 162

[56] References Cited

U.S. PATENT DOCUMENTS

| | | | |
|---|---|---|---|
| 2,794,097 | 5/1957 | Jacob, Jr. | 337/293 |
| 2,964,604 | 12/1960 | Jacob, Jr. et al. | 337/159 |
| 3,113,195 | 12/1963 | Kozacka | 337/161 |
| 3,394,333 | 7/1968 | Jacob, Jr. | 337/291 |
| 4,125,819 | 11/1978 | Jacob, Jr. | 337/161 |

*Primary Examiner*—Harold Broome
*Attorney, Agent, or Firm*—Erwin Salzer

[57] ABSTRACT

A ribbon-type fusible element is subdivided by equidistant points of equally reduced cross-section into a plurality of serially connected fusible element sections. These include first angularly bent fusible element sections comprising two half-sections, second fusible element sections being planar and arranged in spaced relation from the first fusible element sections, a planar support for the second fusible element sections; and third fusible element sections which are angularly bent and conductively interconnect the first and the second fusible element sections. The above planar support includes a portion that extends in a direction longitudinally of the fusible element and transverse arms that are in registry with the second fusible element sections. Fastener means project through said transverse arms and said second fusible element sections. As a result, the sections of the fusible element situated between contiguous fasteners are fixedly supported.

6 Claims, 5 Drawing Figures

1
1a
1b
1c
2
3
3a
3b
4
A
B
C
X
Y
a
c
III

FUSIBLE ELEMENT FOR ELECTRIC FUSES HAVING A RELATIVELY HIGH VOLTAGE RATING AND A RELATIVELY HIGH CYCLING PERFORMANCE

BACKGROUND OF THE INVENTION

In some instances a high cycling capacity is required of electric current-limiting fuses, particularly if such fuses are arranged in electric circuits which include solid state devices such as, for instance, transistors and thyristors. The requirement of high cycling capacity is usually met in high voltage fuses by a zig-zag configuration of the fusible elements. High-voltage fuses were in the past generally used in electric distribution systems where the duty cycles are not very severe and do not involve a relatively large number of changes per unit of time.

SUMMARY OF THE INVENTION

Fusible elements according to the present invention include a narrow ribbon of sheet metal, e.g. silver, subdivided by equidistant points of equally reduced cross-section into a plurality of serially connected fusible element sections.

Said plurality of fusible element sections includes first fusible element sections angularly bent in the center thereof to form fusible element half-sections separated by non-perforated edges.

Said plurality of fusible element sections further includes second fusible element sections being planar and arranged in spaced relation from one of said plurality of first fusible element sections.

A fusible element according to the present invention further includes a support of electric insulating material extending in a direction longitudinally of said ribbon and having transverse arms in registry with said second fusible element sections.

Fastener means project transversely through said arms and said second fusible element section and firmly affix said second fusible element sections to said arms.

Said plurality of fusible element sections further include third fusible element sections conductively interconnecting said first fusible element sections and said second fusible element sections. Said third fusible element sections being angularly bent in the center thereof to form half-sections separated by non-perforated edges. Each of said half-sections of said third fusible element sections having one end co-planar with said second fusible element sections and another end co-planar with one of said half-sections of one of said first fusible element sections.

DESCRIPTION OF PREFERRED EMBODIMENT

Figures 1, 2, 3:
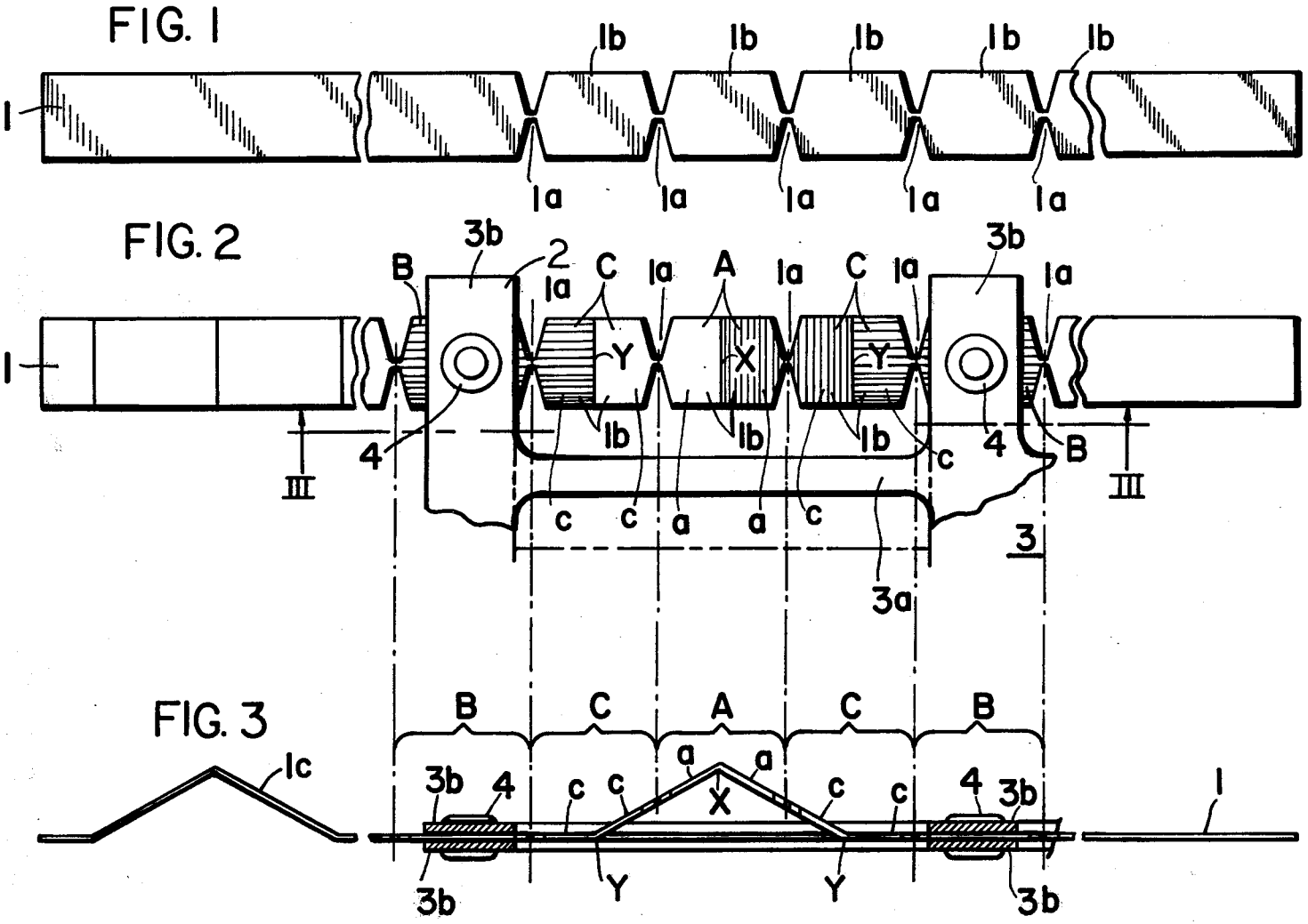
FIG. 1 is a top plan view of a fusible element in accordance with the present invention prior to bending it into fusible element sections and supporting it by a fusible element support.
FIG. 2 is a top plan view of a portion of a properly bent and supported fusible element according to this invention.
FIG. 3 is a section along III—III of FIG. 2.
Figure 4:
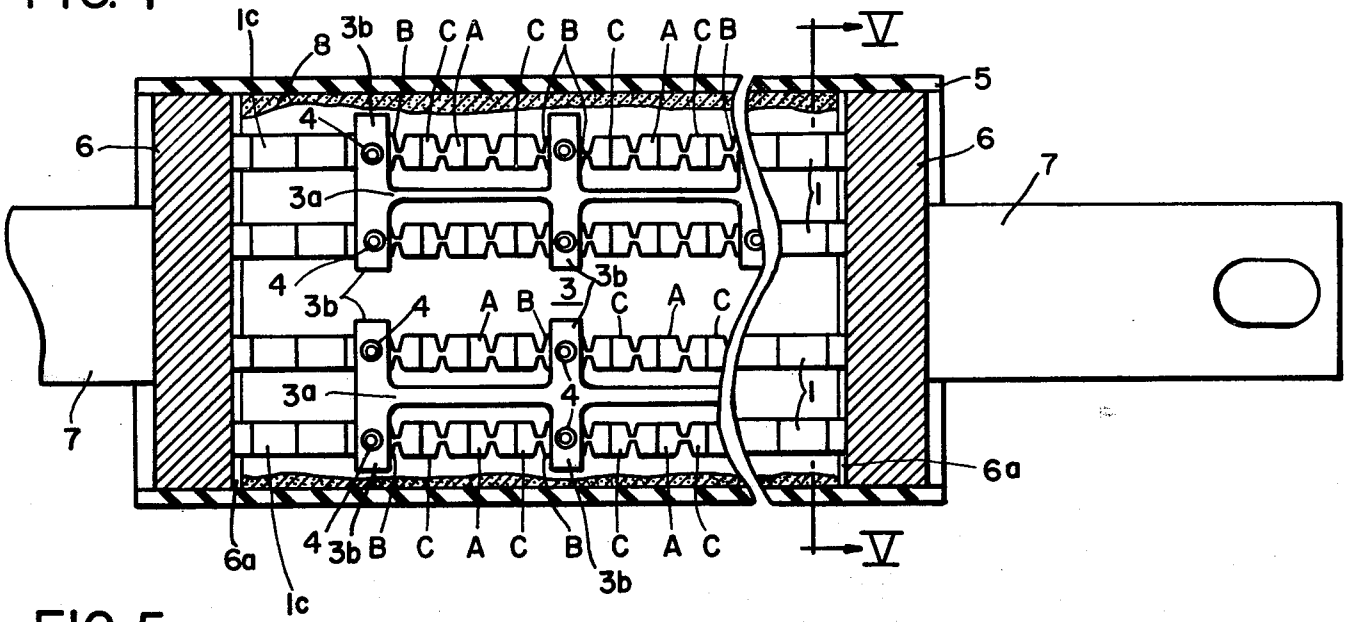
FIG. 4 is a section of an entire fuse including fusible elements according to the present invention.
Figure 5:
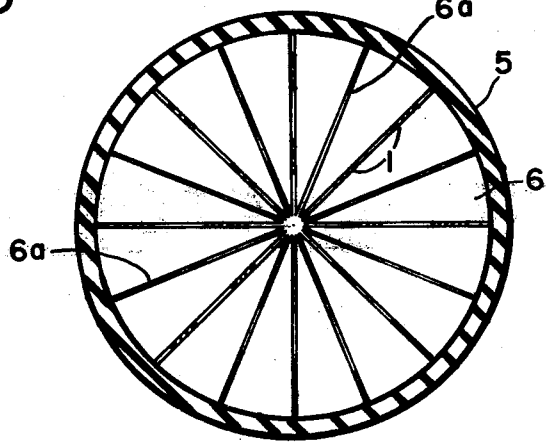
FIG. 5 is a section along V—V of FIG. 4.

In the drawings, and more particularly in FIGS. 2,3 and 4 thereof, numeral 1 has been applied to indicate a narrow ribbon of sheet metal subdivided by points 1*a* of equally reduced cross-section into a plurality of serially connected fusible element sections 1*b*. All fusible element sections 1*b* separated by points of reduced cross-section 1*a* are congruent. Reference character A has been applied to indicate some of fusible element sections 1*b*. Fusible element sections A will be referred-to as first fusible element sections. Each first fusible element section A is angularly bent at the center thereof to form two half sections a,a separated by a non-perforated edge X. Half sections a,a enclose preferably an obtuse angle.

The plurality of fusible element sections 1*b* further include fusible element sections referred-to as second fusible element sections B. Sections B are arranged in spaced relation from said first fusible element sections A and are the only planar sections involved in the fusible element structure.

Reference numeral 3 has been applied to generally indicate a fusible element support. Support 3 is made of an electric insulating material, e.g. a laminate of glass-cloth and melamine. It comprises a portion 3*a* extending in a direction longitudinally of ribbon 1 and having transverse arms or projections 3*b*. These arms or projections 3*b* are arranged in registry with sections B of the fusible element 1. A fastener means 4, e.g. an eyelet, projects transversely through arms or projections 3*b* and fusible element sections B and firmly affixes fusible element sections B to projections or arms 3*b*.

The above referred-to plurality of fusible element sections 1*b* further include fusible element sections referred-to as third fusible element sections C. Fusible element sections C are bent in the center region thereof, preferably at an obtuse angle and they interconnect conductively fusible element sections A and B. The bent Y in fusible element sections C establishes half-sections separated by the aforementioned non-perforated edges Y.

It will be apparent, particularly from FIG. 3, that sections A and C are bent in different directions, i.e. sections A are bent upwardly in roof-like fashion, and sections C have one half-section c which is parallel to arms 3 and another half-section c slanting upwardly. In other words, one of the ends of each half-section c is co-planar with fusible element sections B and another end of half-section c is co-planar with one half-section a of fusible element section A.

It will thus be apparent that prior to bending all fusible element sections are congruent, and that after bending fusible element sections A and C are bent in different directions while fusible element sections B are not bent, i.e., they remain in their initial planar state.

The shape of sections A,B and C undergoes cyclic changes and repeats itself. As can best be seen from FIG. 4, the cyclic change is as follows: B,C,A,C,B,-C,A,C,B. . . .

In FIG. 4 showing a complete fuse embodying this invention reference numeral 5 has been applied to indicate a tubular casing of electric insulating material, e.g. glass-cloth melamine. Casing 5 is closed on the end thereof by a pair of terminal plugs 6 affixed to casing 1 by appropriate means (not shown). Blade contacts 7 extend axially outwardly from terminal plugs 6. Ribbon 1 of sheet metal conductively interconnects terminal plugs 6. The insulating support of FIGS. 2 and 3 has been doubled in FIG. 4, i.e., provided with right arms and left arms or projections, so as to be capable of supporting two fusible elements 1 instead of but one such element. Fusible elements 1 and their supports 3*a*,3*b* are immersed in a pulverulent arc-quenching filler 8, e.g. quartz sand. The axially inner end surfaces of terminal plugs are provided with radial grooves 6*a* into which the ends of fusible elements 1 are inserted and conductively connected to terminal plugs by soft solder joints (not shown). Fusible elements 1 form bents 1*c* adjacent the ends thereof to increase the flexibility thereof and account for thermal expansion and contraction.

FIG. 3 shows the fusible element 1 sandwiched between two arms 3*b*,3*b*. This is to suppress access of arc-extinguishing filler 8 to fusible element sections B. The theory underlying this step is more fully described in U.S. Pat. 2,964,604 to Philip C. Jacobs, Jr. et al, for CURRENT-LIMITING FUSES HAVING COMPOUND ARCVOLTAGE GENERATING MEANS, issued Dec. 13, 1960. Reference may be had to that patent for further information in regard to sandwiching fusible element sections C preferably between arms 3*b* of a gas-evolving material.

The points of drastically reduced cross-section 1*a* are preferably established by V-shaped incisions at opposite longitudinal edges of fusible element 1. This kind of incisions is desirable since it tends to limit stresses in the fusible element 1 resulting from stamping operations and allows to minimize the cross-section of the fusible element at the points of reduced cross-section thereof. The greater the length of the fusible element, the larger the number of points of reduced cross-section and the smaller their cross-section, the greater the benefits which may be derived from the present invention.

The points where fasteners or eyelets 4 project through fusible element sections B are fixed points establishing a substantially stable spacing of fusible element sections B. Since fusible subsections C are planar, and co-planar, respectively, these sections do not have to compress portions of the quartz sand as all portions of a fusible element do that are angularly related to one another. It will be noted from the above that half-sections c and a are coplanar, and that half-sections c and sections B are coplanar.

I claim as my invention:

1. A fusible element for electric fuses having a relatively high voltage rating and a relatively high cycling capability comprising in combination (a) a narrow ribbon of sheet metal subdivided by equidistant points of equally reduced cross-section into a plurality of serially connected fusible element sections;

(b) said plurality of fusible element sections including first fusible element sections angularly bent in the center thereof to form fusible element half-sections separated by non-perforated edges;

(c) said plurality of fusible element sections further including second fusible element sections being planar and arranged in spaced relation from one of said plurality of first fusible element sections;

(d) a fusible element support of electric insulating material extending in a direction longitudinally of said ribbon and having transverse arms arranged in registry with said plurality of second fusible element sections;

(e) fastener means projecting transversely through said arms and said second fusible element sections and firmly affixing said second fusible element sections to said arms; and (f) said plurality of fusible element sections further including third fusible element sections conductively interconnecting said first fusible element sections and said second fusible element sections, said third fusible element sections being angularly bent in the center thereof to form half-sections separated by non-perforated edges, each of said half-sections of said third fusible element sections having one end co-planar with said second fusible element sections and another end co-planar with one of said half-sections of one of said first fusible element sections.

2. A fusible element for electric fuses having a relatively high voltage rating and a relatively high cycling capability comprising (a) a narrow ribbon of sheet metal subdivided by a plurality of pairs of incisions at opposite edges thereof into a string of congruent fusible element sections;

(b) a plurality of spaced first fusible element sections angularly bent in the center thereof to form half-sections separated by non-perforated edges;

(c) a plurality of second fusible element sections each arranged in spaced relation from one of said plurality of first fusible element sections and each being planar;

(d) a planar fusible element support of electric insulating material extending in a direction longitudinally of said ribbon and having transverse projections arranged in registry with said plurality of second fusible element sections;

(e) fastener means projecting through said projections and through said second fusible element sections and firmly affixing points of the latter to the former; and (f) a plurality of third fusible element sections conductively interconnecting said first fusible element sections and said second fusible element sections, said third fusible element sections being co-planar with said second fusible element sections at the ends thereof adjacent said second fusible element sections, and said third fusible element sections having the same inclination as said first fusible element half-sections at the ends thereof adjacent said sections.

3. A fusible element for electric fuses having a relatively high voltage rating and a relatively high cycling capability comprising (a) a ribbon of sheet silver having equidistant pairs of opposite V-slots defining a plurality of equidistant regions of drastically reduced cross-section and congruent fusible element sections situated between said plurality of regions of drastically reduced cross-section;

(b) a plurality of first fusible element sections angularly bent at the centers thereof to form pairs of first fusible element half-sections separated by non-perforated edges;

(c) a plurality of second fusible element sections spaced from said first fusible element sections a distance equal to the spacing between contiguous said regions of drastically reduced cross-section;

(d) a fusible element support of electric insulating material extending in a direction longitudinally of said ribbon and having transverse arms registering with said plurality of second fusible element sections;

(e) fasteners projecting through said transverse arms and through said second fusible element sections and firmly affixing points of the latter to the former; and (f) a plurality of third fusible element sections conductively interconnecting said first fusible element sections and said second fusible element sections.

4. A fusible element as specified in claim 3 wherein said fastener means are eyelets projecting through said transverse arms and through said second fusible element sections.

5. A fusible element as specified in claim 3 wherein each of said arms consists of a pair of plates of a gas-evolving material sandwiching therebetween said second fusible element sections.

6. A fusible element for electric fuses having a relatively high voltage rating and a relatively high cycling capacity comprising (a) a ribbon of sheet metal subdivided by equidistant points of equally reduced cross-section into a plurality of serially related fusible element sections;

(b) said plurality of fusible element sections including spaced first fusible element sections bent in transverse direction to form pairs of first fusible element half-sections which are planar, the planes of which enclose an obtuse angle and are separated from each other by a non-perforated edge;

(c) said plurality of fusible element sections also including second fusible element sections which are planar in their entirety and are arranged in spaced relation from said first fusible element sections;

(d) said plurality of fusible element sections further including third fusible element sections bent in transverse direction to form pairs of third fusible element half-sections which are planar, the planes of which enclose an obtuse angle and are separated from each other by a non-perforated edge, said third fusible element sections being arranged in the spaces between and interconnecting said first fusible element sections and said second fusible element sections, each of said third fusible half-sections being coplanar with one of said first fusible element half-sections, and each of said third fusible element half-sections being coplanar with one of said second fusible element sections;

(e) a planar support of electric insulating material interconnecting said plurality of second fusible element sections, said support extending in a direction longitudinally of said ribbon of sheet metal and having transverse arms arranged in registry with said second fusible element sections and tying together said second fusible element sections.

* * * * *